United States Patent [19]

Kanno

[11] Patent Number: 4,850,906

[45] Date of Patent: Jul. 25, 1989

[54] ENGINE CONTROL PANEL FOR A WATERCRAFT PROPELLED BY A PLURALITY OF MOTORS

[75] Inventor: Isao Kanno, Hamamatsu, Japan

[73] Assignee: Sanshin Kogyo Kabushiki Kaisha, Hamamatsu, Japan

[21] Appl. No.: 267,696

[22] Filed: Nov. 2, 1988

Related U.S. Application Data

[63] Continuation of Ser. No. 893,093, Aug. 4, 1986, abandoned.

[30] Foreign Application Priority Data

Aug. 9, 1985 [JP] Japan ..... 60-176004

[51] Int. Cl.[4] ..... F01B 21/00

[52] U.S. Cl. ..... 440/2; 60/719; 123/198 DC; 123/DIG. 8; 123/179 BG

[58] Field of Search ..... 60/698, 705, 716, 719, 60/728; 340/984; 440/1-3, 49, 79, 84, 85; 123/198 C, DIG. 8, 198 D, 179 B, 179 BG; 114/211, 270

[56] References Cited

U.S. PATENT DOCUMENTS

| | | | |
|---|---|---|---|
| 1,652,504 | 12/1927 | Thau | 440/1 |
| 2,467,685 | 4/1949 | Newcomb | 60/719 |
| 2,637,169 | 5/1953 | Fell | 60/719 |
| 2,914,018 | 11/1959 | Schachner | 440/85 |
| 3,392,696 | 7/1968 | Buckley | 440/1 |
| 3,489,912 | 1/1970 | Hoffman | 114/211 |
| 3,786,892 | 1/1974 | Horton | 440/85 |
| 3,797,447 | 3/1974 | Stubblefield | 440/1 |
| 4,479,357 | 10/1984 | Stewart | 60/719 |
| 4,649,708 | 3/1987 | Fisher | 60/719 |

FOREIGN PATENT DOCUMENTS

| | | | |
|---|---|---|---|
| 59-92095 | 6/1984 | Japan | 440/85 |

*Primary Examiner*—Joseph F. Peters, Jr.
*Assistant Examiner*—Clifford T. Bartz
*Attorney, Agent, or Firm*—Ernest A. Beutler

[57] ABSTRACT

A control panel for a watercraft powered by a plurality of engines wherein the controls for each of the engines is mounted on the same panel. The controls comprise at least a first pair of control elements for controlling separate functions of the engine independently but positioned in juxtaposition to each other and a common control element for controlling the same functions of both engines.

15 Claims, 3 Drawing Sheets

ENGINE CONTROL PANEL FOR A WATERCRAFT PROPELLED BY A PLURALITY OF MOTORS

This is a continuation of U.S. patent application Ser. No. 893,093, filed Aug. 4, 1986; now abandoned.

BACKGROUND OF THE INVENTION

This invention relates to an control panel for a watercraft that is propelled by a plurality of motors and more particularly to an improved, and simplified control arrangement for plural motors of a watercraft.

In many types of watercraft, it is the practice to use two or even more propelling engines. This is done both with inboard engines and also with outboard motors wherein it is common to use two or three motors for more power. However, the normal practice in connection with such engines is that each engine is relatively independent of the other and has its own separate controls. The positioning of these controls in a manner where they can be conveniently operated by the driver of the watrecraft and, at the same time, positioned and arranged in such a way that the operator controls the correct engine presents a number of problems. One of these problems is the adequate placement of all of the controls. For example, each engine may be supplied with a separate control panel that contains various controls such as a master switch, a choke switch and/or a kill switch. In addition, certain types of warning devices and warning lamps may also be provided on the control panel. If plural control panels must be mounted on the watercraft, it is obvious that the space required will be great. In addition, the adjacent mounting of plural control panels does not provide the operator with the proximity of the same controls for the various engines. That is, it is desirable for the operator to have the individual controls, such as the respective master switches and/or choke switches disposed adjacent to each other and in a relationship that corresponds to the relationship of the engines within the watercraft.

It is, therefore, a principal object of this invention to provide an improved and simplified control panel arrangement for a watercraft propelled by a plurality of motors.

It is another object of this invention to provide an improved, compact and convenient control arrangement for the plural motors of a watercraft.

SUMMARY OF THE INVENTION

The invention is adapted to be embodied in an engine control panel for controlling at least a pair of engines for a watercraft and comprises a control panel. A first pair of separate control elements are supported in juxtaposition to each other on the control panel. Each of the first control elements is adapted to provide a separate control function for the respective engine. In addition, a common control element is supported on the control panel and is adapted to control the same function for both engines.

DETAILED DESCRIPTION OF THE PREFERRED EMBODIMENT

Figure 1:
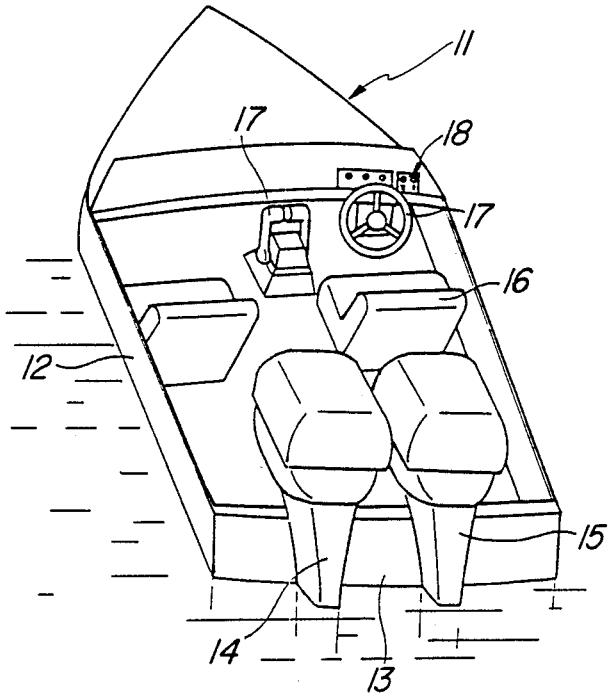
FIG. 1 is a perspective view of a watercraft having a plural powering motors and a control panel constructed in accordance with an embodiment of the invention.
Figure 2:
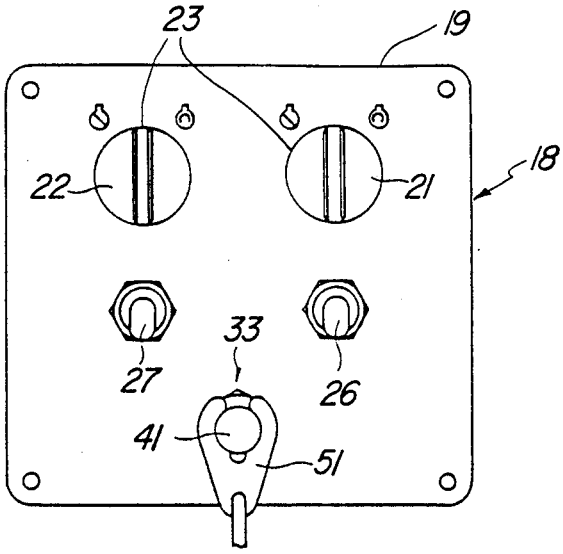
FIG. 2 is an enlarged front elevational view of the control panel.
Figure 3:
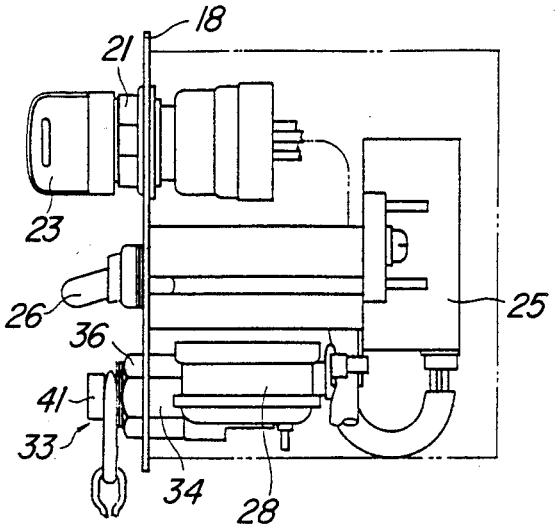
FIG. 3 is a side elevational view of the control panel.
Figure 4:
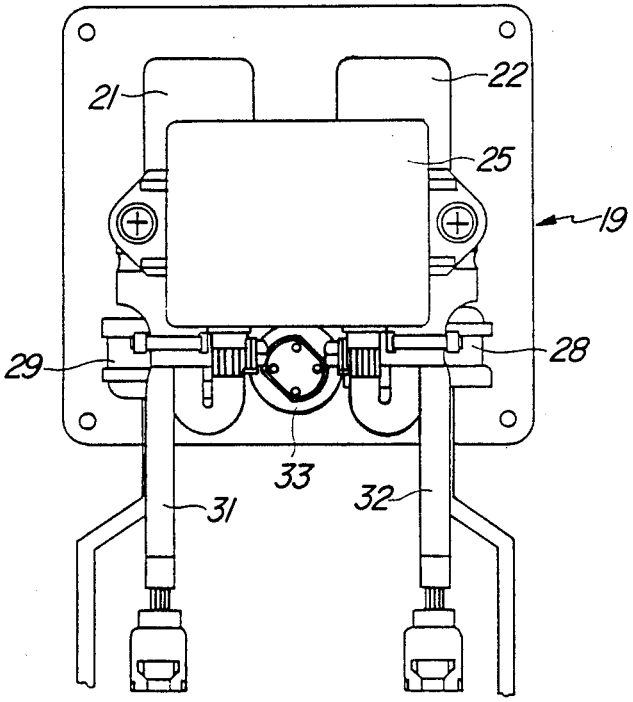
FIG. 4 is a rear elevational view of the control panel.

Referring first to FIG. 1, a watercraft embodying the invention is identified generally by the reference numeral 11. The watercraft 11 is comprised of a hull 12 having a transom 13 on which are mounted a pair of outboard motors 14 and 15. Although the invention is described in conjunction with the use of a pair of outboard motors, it is to be understood that the invention may be practiced in combination with watercraft having more than two motors and/or watercraft with inboard mounted engines.

The interior of the watercraft 12 is provided with a driver's seat 16 that is positioned to the rear of a steering wheel 17. A combined throttle, transmission control mechanism 17 is also positioned in proximity to the driver's seat 16. A control panel, indicated generally by the reference numeral 18, and constructed in accordance with an embodiment of the invention, is positioned on the dash panel in front of the driver's seat.

Referring now in detail to the remaining figures, the construction of the control panel 18 will be describe. The control panel 18 is comprised of a panel face 19 that may be formed from a suitable material and which mounts a number of controls, in a manner to be described. Because of the fact that there is a single panel face 19, the mounting of the control panel 18 is simpler than if there were a plurality of separate control panels and, furthermore, as will become apparent, the individual engine controls can be located in groups next to each other.

Mounted on the control panel face 19 in adjacent relationship are a pair of master switches 21 and 22. The switch 22 is for the motor 14 while the switch 21 is for the motor 15. In this way, the operator will know easily which switch controls which motor since the switches are arranged in the same relationship as the motor. Each switch 21 and 22 is operated by a key 23. Preferably, the keys 23 are identical in construction and in their form so that the operator need not place a specific key in a specific one of the master switches 21 and 22.

The master switches 21 and 22 are connected by means of conductors to a control unit 25 that functions to transfer power to the outboard motors 14 and 15 and also to the outboard motors 14 and 15. If desired, the control unit 25 may employ a control circuit as shown in copending application Ser. No. 869,134, (now U.S. Pat. No. 4,708,669, issued 11/24/87) entitled "Warning Device For A Watercraft Provided With A Plurality Of Marine Propulsion Engines", filed May 30, 1986 in the names of Isao Kanno and Yasuo Yamamoto and assigned to the assignee of this invention. Basically, the control device of that patent application functions to permit individual control of the outboard motors, however, in the event a malfunction of one outboard motor occurs, both that outboard motor and the normally functioning outboard motor will be slowed so as to prevent damage to the malfunctioning outboard motor and while maintaining good control of the associated watercraft.

Any of a plurality of other controls, such as a pair of choke controls 26 and 27 are mounted in adjacent pairs on the panel face 19 for controlling functions of the outboard motors such as the choking for cold starting.

The rear side of the control panel face 19 further can mount a pair of warning buzzers 28 and 29 that are controlled by the control circuit 25 and which give an audible signal in the event of a failure or dangerous condition indication from one of the motors 14 and 15 through the control circuit 25.

Main conductors 31 and 32 extend from the mail switches 21 and 22 and control circuit 25 to the respective motors 15 and 14.

Figure 5:
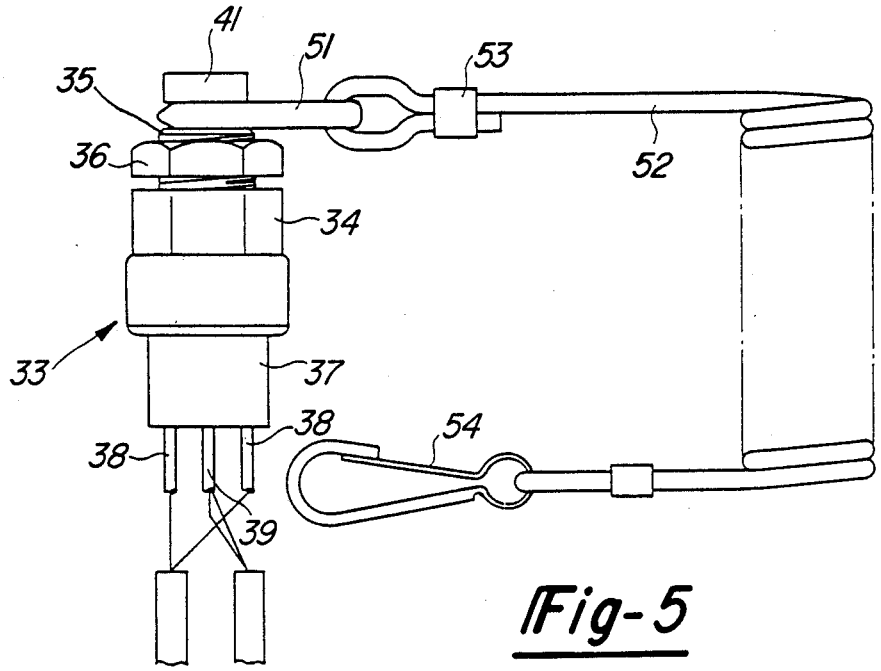
FIG. 5 is an enlarged side elevational view of the kill switch, its actuating mechanism, and its connectors.
Figure 6:
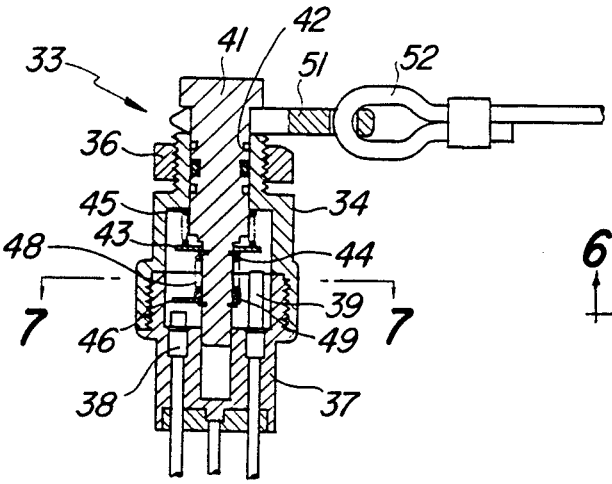
FIG. 6 is a cross-sectional view taken generally along the line 6—6 of FIG. 7.
Figure 7:
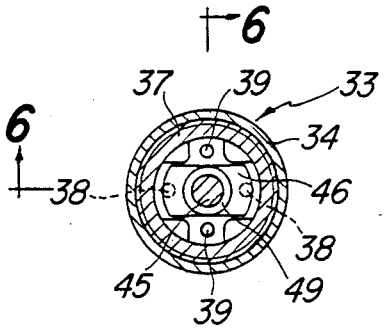
FIG. 7 is a cross-sectional view taken along the line 7—7 of FIG. 6.

A kill switch, indicated generally by the reference numeral 33 and having a construction as best shown in FIGS. 5 through 7 is provided for killing both of the outboard motors 14 and 15. In this way, a single kill switch disables both outboard motors and thus simplifies the overall panel control.

Referring now primarily to FIGS. 5 through 7, the kill switch 33 is comprised of a main housing 34 that is generally cylindrical in shape but which has a hexagonal shape portion so as to facilitate gripping by an appropriate wrench. Adjacent the hexagonal portion, there is formed a threaded part 35 that receives a nut 36 so as to permit attachment of the kill switch 33 to the control panel face 19.

A connector portion 37 is threaded into the housing 34 and carries a first pair of terminals 38 that are associated with one of the outboard motors for grounding out and stopping its ignition and a second pair of terminals 39 which are associated with the other of the outboard motors for serving the same purpose. It should be noted that the ends of the terminals 38 are aligned on one diametral plane of the connector 37 while the other pair of terminals 39 are aligned on a diametral plane which extends at right angles to the plane carrying the terminals 38.

A plunger 41 is slidably supported within a bore 42 of the housing 34. The plunger 41 carries a first contact 43 which is biased against a snap ring 44 by a coil compression spring 45. The coil compression spring 45 bears against the housing 35 and thus urges the plunger 41 in a downward direction as viewed in FIG. 6 which is inwardly of the panel 18 in actual use. The contact 43 is aligned with the terminals 39 and is adapted to complete the circuit between them for killing of the associated engine when the plunger 41 moves inwardly. A further floating contact 46 is carried by the plunger 41 in an axially spaced relationship to the floating contact 43. The floating contact 46 is urged downwardly by means of a coil compression spring 48 that abuts against the snap ring 44 so as to normally urge the floating contact 46 against a similar snap ring. An insulator 49 insulates the contact 46 from the spring 48.

The plunger 41 is normally held in a position wherein the kill switch is held open by means of a lock plate 51 that is received within a groove of the plunger 41 and thus holds the plunger 41 in its retracted or opened position as shown in the figures. The lock plate 51 is connected to one end of a safety cord 52 by means of a fastener 53. The other end of the safety cord 52 is connected to a clip 54 so as to permit the cord 52 to be attached around the waist of the driver. if the driver is thrown from the watercraft, the cord 52 will pull the lock plate from the groove in the plunger 41 and the plunger 41 will be urged downwardly by the action of the spring 45 so that the floating contact 43 will contact the terminals 39 and kill their engine and, at the same time, the contact 46 will contact the terminals 38 to kill their engine.

It should be readily apparent that the described construction permits a very compact control panel and yet, at the same time, places all of the controls in an appropriate and adjacent position so that the operator can readily determine which engine he is controlling. In addition, by employing a common kill switch for both engines, the panel is simplified. Although an embodiment of the invention has been illustrated and described, it should be readily apparent to those skilled in the art that various changes and modifications may be made without departing from the spirit and scope of the invention, as defined by the appended claims.

I claim:

1. An engine control panel for controlling at least a pair of engines each driving a respective propulsion device for a watercraft comprising a control panel, a first pair of separate control elements supported in juxtaposition to each other by said control panel, each of said first control elements being adapted to provide a separate control function for the respective engine, and a common control element supported on said control panel and adapted to control the same function for both of said engines, said control panel and said control elements being mountable as a unit in the watercraft.

2. An engine control panel as set forth in claim 1 further including a second pair of separate control elements supported in juxtaposition to each other on said control panel and each being adapted to provide a separate control function for the respective engine.

3. An engine control panel as set forth in claim 2 wherein at least one of the pairs of control elements is a warning element.

4. An engine control panel as set forth in claim 2 wherein at least one of the control elements comprises a master switch.

5. An engine control panel for controlling at least a pair of engines for a watercraft comprising a control panel, a first pair of separate control elements supported in juxtaposition to each other by said control panel, each of said first control elements being adapted to provide a separate control function for the respective engine, and a common control element supported on said control panel and adapted to control the same function for both of said engines, said first pair of separate control elements comprising master switches operated by identically shaped keys.

6. An engine control panel as set forth in claim 5 wherein the common control element comprises a kill switch.

7. An engine control panel as set forth in claim 6 wherein the kill switch comprises a housing supporting a first pair of terminals and a second pair of terminals, a plunger slidably supported by said housing and carrying a first contact for engaging the first pair of terminals and completing a circuit between them and a second contact for engaging the second pair of terminals and completing a circuit between them.

8. An engine control panel as set forth in claim 1 wherein the common control element comprises a kill switch.

9. An engine control panel for controlling at least a pair of engines for a watercraft comprising a control panel, a first pair of separate control elements supported in juxtaposition to each other by said control panel, each of said first control elements being adapted to provide a separate control function for the respective engine and a common kill switch supported on said control panel, said kill switch comprising a housing supporting a first pair of terminals and a second pair of terminals, a plunger slidably supported by said housing and carrying a first contact for engaging the first pair of terminals and completing a circuit between them and a second contact for engaging the second pair of terminals and completing a circuit between them.

10. An engine control panel as set forth in claim 4 wherein the separate control elements comprise the master switches and the master switches are key operated.

11. An engine control panel as set forth in claim 1 in combination with a watercraft having a first engine and a second engine.

12. An engine control panel as set forth in claim 11 further including a second pair of separate control elements supported in juxtaposition to each other on said control panel and each being adapted to provide a separate control function for the respective engine.

13. An engine control panel as set forth in claim 12 wherein at least one of the pairs of control elements is a warning element.

14. An engine control panel as set forth in claim 12 wherein at least one of the control elements comprises a master switch.

15. An engine control panel as set forth in claim 14 wherein the separate control elements comprise the master switches and the master switches are key operated.

* * * * *